US011236549B2

(12) United States Patent
Purcell et al.

(10) Patent No.: US 11,236,549 B2
(45) Date of Patent: Feb. 1, 2022

(54) DRILL BIT WITH DETACHABLE BIT HEAD

(71) Applicant: Mincon International Limited, Shannon (IE)

(72) Inventors: Joseph Purcell, Ennis (IE); Ciaran Purcell, Ennis (IE)

(73) Assignee: Mincon International Limited, Shannon (IE)

( * ) Notice: Subject to any disclaimer, the term of this patent is extended or adjusted under 35 U.S.C. 154(b) by 3 days.

(21) Appl. No.: 16/630,960

(22) PCT Filed: Jul. 17, 2018

(86) PCT No.: PCT/EP2018/069434

§ 371 (c)(1),
(2) Date: Jan. 14, 2020

(87) PCT Pub. No.: WO2019/016230

PCT Pub. Date: Jan. 24, 2019

(65) Prior Publication Data

US 2020/0224502 A1 Jul. 16, 2020

(30) Foreign Application Priority Data

Jul. 20, 2017 (IE) ..... 2017/0150
Mar. 8, 2018 (IE) ..... 2018/0049

(51) Int. Cl.
*E21B 10/62* (2006.01)
*E21B 10/36* (2006.01)
(Continued)

(52) U.S. Cl.
CPC ..... *E21B 10/62* (2013.01); *E21B 10/36* (2013.01); *E21B 1/00* (2013.01); *E21B 4/14* (2013.01)

(58) Field of Classification Search
CPC . E21B 1/00; E21B 10/36; E21B 10/38; E21B 10/62; E21B 10/627; E21B 4/14; E21B 4/00; E21B 1/02
See application file for complete search history.

(56) References Cited

U.S. PATENT DOCUMENTS 3,952,819 A 4/1976 Adcock
2002/0014354 A1 2/2002 Patterson
(Continued)

FOREIGN PATENT DOCUMENTS

AU 503077 B2 8/1979
EP 1 757 769 A1 2/2007
(Continued)

OTHER PUBLICATIONS

International Search Report from corresponding International Patent Application No. PCT/EP2018/069434, dated Oct. 19, 2018.

*Primary Examiner* — Caroline N Butcher
(74) *Attorney, Agent, or Firm* — Kusner & Jaffe

(57) ABSTRACT

A drill bit assembly for fluid-operated percussion drill tools. The assembly comprises a percussion bit comprising a bit head detachably connected to an axially extending shank and engagement means formed on an external wall of the shank engageable with complementary engagement means formed internally of a drive chuck whereby rotational drive from the chuck may be transmitted to the shank. At least one flushing channel extends between the external wall of the bit shank and a cutting face of the bit head, to provide a fluid path for a flushing medium between the external wall of the bit shank and the cutting face of the bit head.

12 Claims, 8 Drawing Sheets

(51) Int. Cl.
*E21B 1/00* (2006.01)
*E21B 4/14* (2006.01)

(56) References Cited

U.S. PATENT DOCUMENTS

| | | | | |
|---|---|---|---|---|
| 2011/0042146 | A1* | 2/2011 | Lachmann | E21B 10/36 175/414 |
| 2011/0209919 | A1* | 9/2011 | Aros | E21B 10/38 175/296 |
| 2016/0069134 | A1* | 3/2016 | Carlsson | E21B 10/36 175/57 |

FOREIGN PATENT DOCUMENTS

| | | | | |
|---|---|---|---|---|
| EP | 1757769 | A1 * | 2/2007 | E21B 10/36 |
| WO | WO-2009/136385 | A2 | 11/2009 | |
| WO | WO-2014/185855 | A2 | 11/2014 | |
| WO | WO-2015/026905 | A1 | 2/2015 | |

* cited by examiner

DRILL BIT WITH DETACHABLE BIT HEAD

FIELD OF THE INVENTION

The present invention relates to a drill bit assembly for fluid-operated percussion drill tools. In particular, the invention concerns a drill bit assembly for use with down-the-hole hammers, particularly hydraulic down-the-hole hammers.

BACKGROUND TO THE INVENTION

Percussion bits for fluid-operated percussion drill tools, such as down-the-hole hammers, typically comprise a bit head, populated with cutting inserts on the front face of the head. The bit head is formed with an axially extending shank having a smaller diameter than the bit head. As the hammer rotates, rotational drive is most commonly transmitted to the shank by way of splines provided on the external cylindrical wall on the shank which mate with splines provided internally of a drive chuck of the drill tool. Other possible drive arrangements include a hexagonal or octagonal shank, which mates with a correspondingly formed chuck.

During the drilling cycle, an impact piston collides with a rear end of the shank, forcing the cutting inserts on the bit head into the rock being drilled. Pressurised air, known as flushing air, is used to flush cuttings out of the hole while the hammer operates. Lubricating oil may be added to the flushing air stream at the drill rig. Flushing air is typically provided using one of two mechanisms.

In centre flushing systems, the drill bit has a flushing bore running through the centre of the shank and extending though the bit face, often splitting into multiple channels before emerging through the front face of the bit. A corresponding centre flushing bore runs through the entire length of the piston, feeding flushing air from the drill rig to the bit face.

In external flushing systems, the flushing air travels along the splines (or other drive arrangement) of the bit shank rather than through a centre flushing bore. In this arrangement, the bit shank is solid and channels may be provided in the bit head to direct the air from the splines to the cutting face of the bit.

For both of the above-described arrangements, the shank and the bit head are generally integrally formed, for example, by machining the drill bit from a single billet or forging. In conventional hammers, when the bit head or cutting face is worn out, the shank can often be in good condition but because it is made integral with the cutting face, it must be discarded. The premature wearing out of the head/cutting face may occur where drilling is carried out in very abrasive rock or material which wears the inserts in the cutting head.

In certain centre flushing arrangements, the drill bit may be formed in two separate parts, which may be joined together by way of a threaded connection, which allows the bit head to be replaced without requiring the shank to be discarded unnecessarily. However, there are certain drawbacks associated with centre flushing arrangements. As flushing air containing lubricating oil is forced through the bore of the drill bit, cavitation can occur due to the presence of the oil. This issue is exacerbated when the piston collides with the drill bit forcing oil out at high velocity from the annular region enclosed by the mating piston nose and bit shank. Cavitation damage is often observed on the piston nose and at the rear end of the bit shank. Another drawback of centre flushing arrangements is that the splines may suffer from inadequate lubrication. Although some flushing air will inevitably leak into the splined section of the bit, it will not always provide sufficient lubrication, particularly in applications where the flushing air pressure is relatively low. Inadequate spline lubrication increases the risk of damage due to friction and possible failure caused thereby.

While centre flushing arrangements may be acceptable for pneumatic down-the-hole hammers where flushing air is typically provided at (or close to) the same pressure as the working fluid, the level of spline lubrication may be insufficient for hydraulic down-the-hole hammers which typically operate at high frequencies and therefore have a greater need for spline lubrication due to friction.

SUMMARY OF THE INVENTION

The present invention provides a drill bit assembly for fluid-operated percussion drill tools comprising:

- a percussion bit comprising a bit head detachably connected to an axially extending shank;
- axially extending splines formed on an external cylindrical wall of the shank slideably engageable with complementary splines formed internally of a drive chuck whereby rotational drive from the chuck may be transmitted to the shank;
- at least one flushing channel extending between the external cylindrical wall of the bit shank and a cutting face of the bit head, to provide a fluid path for a flushing medium between a splined portion of the bit shank and the cutting face of the bit head.

The present invention also provides a drill bit assembly for fluid-operated percussion drill tools comprising:

- a percussion bit comprising a bit head detachably connected to an axially extending shank;
- engagement means formed on an external wall of the shank engageable with complementary engagement means formed internally of a drive chuck whereby rotational drive from the chuck may be transmitted to the shank;
- at least one flushing channel extending between the external wall of the bit shank and a cutting face of the bit head, to provide a fluid path for a flushing medium between the external wall of the bit shank and the cutting face of the bit head.

The engagement means may comprise, for example, an octagonal or hexagonal shank and the complementary engagement means may comprise a correspondingly formed chuck. For example, the shank may be hexagonal in cross section, and chuck may be formed with a double-hexagonal internal profile, such that the shank is engageable with one of the hexagonal profiles of the chuck, allowing flushing medium to pass through channels formed between the shank and the second hexagonal profile. A similar arrangement is also possible for other profiles, such as octagonal profiles.

An advantage of the present invention is that ample spline (or engagement means) lubrication is provided, while minimising the risk of cavitation to the piston nose and avoiding unnecessary replacement of the bit shank. This may be particularly advantageous in hydraulic down-the-hole hammers, which operate at high frequencies and therefore have a greater need for spline lubrication due to friction. Having all of the lubricant-carrying flushing air travel through the splines, rather than just a portion of centre flushing air, means that adequate spline lubrication can be achieved at lower flushing air pressures.

In an embodiment, each of the at least one flushing channels comprises:

a first channel portion in the bit shank extending from the external (cylindrical) wall of the bit shank to an end face of the bit shank adjacent the bit head; and a second channel portion extending through the bit head.

In certain embodiments a first end of the or each first channel portion may intersect the external (cylindrical wall) of the bit shank.

In other embodiments, a first end of the or each first channel portion may be adjacent to the external (cylindrical) wall of the bit shank. The first end of the or each first channel portion may intersect an outwardly directed shoulder on the bit shank adjacent to the external (cylindrical) wall. The bit head may comprise an axially extending shroud, which extends beyond the first end of the or each first channel portion. An advantage of this arrangement is that leakage of flushing medium from the assembly during use is minimised. A chamber may be provided between the end face of the bit shank and the bit head, whereby the chamber connects the first channel portion to the second channel portion.

An advantage of this arrangement is that the flushing air is discharged from the first channel portions into the chamber from where it passes through the second channel portions to the bit face, thereby avoiding the need to provide exact alignment of the first and second channel portions.

In one embodiment, the chamber is provided by way of a shoulder on the bit shank which engages with an outer shoulder at the rear end of the bit head, such that the end face of the bit shank is spaced apart from an internal rear face of the bit head when the drill bit is assembled.

In another embodiment, the chamber is provided by way of a recess in at least one of the end face of the bit shank and an internal rear face of the bit head, wherein the first and second channel portions are in fluid communication with the recess.

The recess may be provided in the form of an annular groove in at least one of the end face of the bit shank and the internal rear face of the bit head. An advantage of this arrangement is that a fluid path between the first channel portions and the second channel portions is formed regardless of the rotational alignment of the bit head and the bit shank.

In another embodiment the recess is centrally located of the end face of the bit shank and/or the internal rear face of the bit head.

The bit head may be screw-threadably connected to the shank. In one embodiment, the first channel portion extends between the external (cylindrical) wall of the bit shank and a threaded portion of the bit shank, so that the first channel portion intersects a screw-thread provided externally of the bit shank. An advantage of this arrangement is that the screw-threaded connection may be lubricated by the flushing fluid, thereby reducing frictional wear in the thread due to microscopic movement between the bit head and shank.

The invention also provides a hydraulic down-the-hole hammer comprising a drill bit assembly as described above.

DETAILED DESCRIPTION OF THE DRAWINGS

Figure 1:
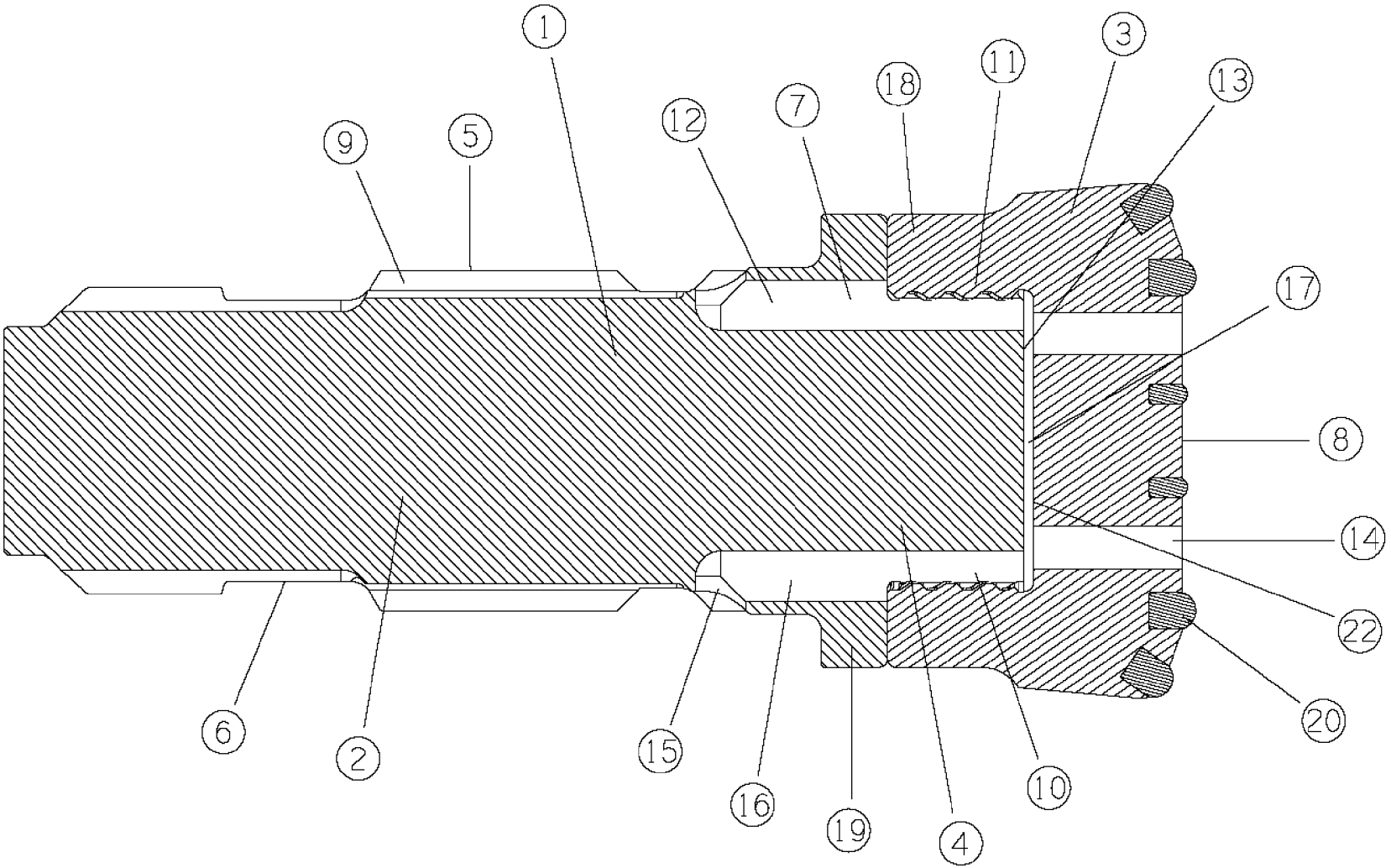
FIG. 1 is a longitudinal cross-section of a drill bit assembly according to a first embodiment of the invention.

A drill bit assembly according to a first embodiment of the invention is illustrated in FIG. 1. The assembly 1 comprises a percussion bit 2 having a bit head 3, provided with tungsten carbide inserts 20, screw-threadably connected to an axially extending shank 4. A male threaded connection 10 is provided at a forward end of the shank to engage with the female threaded connection 11 on the bit head. When the bit is assembled, male connection 10 is engaged with female connection 11 until a shoulder 18 on bit head 3 abuts outer annular shoulder 19 on bit shank 4.

Axially extending splines 5 are formed on an external cylindrical wall 6 of the shank. When the bit assembly is assembled into a percussion drill tool, the splines 5 are slideably engaged with complementary splines formed internally of a drive chuck to transmit rotational drive from the chuck to the shank.

Flushing channels 7 extend between the external cylindrical wall 6 of the bit shank and a cutting face 8 of the bit head, to provide a fluid path for a flushing medium between a splined portion 9 of the bit shank and the cutting face 8 of the bit head. Each of the flushing channels 7 comprises a first channel portion 12 in the bit shank extending from the external cylindrical wall of the bit shank to an end face 13 of the bit shank adjacent the bit head, and a second channel portion 14 extending through the bit head. In the embodiment shown in FIG. 1, the first channel portion 12 extends between the external cylindrical wall of the bit shank and a threaded portion 10 of the bit shank, intersecting the external cylindrical wall at a first end and a threaded portion 10 of the bit shank at a second end. The first channel portion comprises a first section 15 which intersects the wall 6 and a second section 16 which runs parallel to a longitudinal axis of the shank.

As shown in FIG. 1, the screw-threaded connection between the bit head and the bit shank is such that, when shoulders 18 and 19 are abutted against one another, the end face 13 of the bit shank is spaced apart from an internal rear face 22 of the bit head so that a chamber 17 is provided therebetween. The first channel portions 12 and the second channel portions 14 are in fluid communication with the chamber 17.

In use, flushing medium travels along the splines 5 into first channel portions 12 and is discharged into chamber 17, from where it passes into second channel portions 14, exiting through the cutting face of the bit to flush cuttings out of the hole while the percussion drill tool operates.

Figure 2:
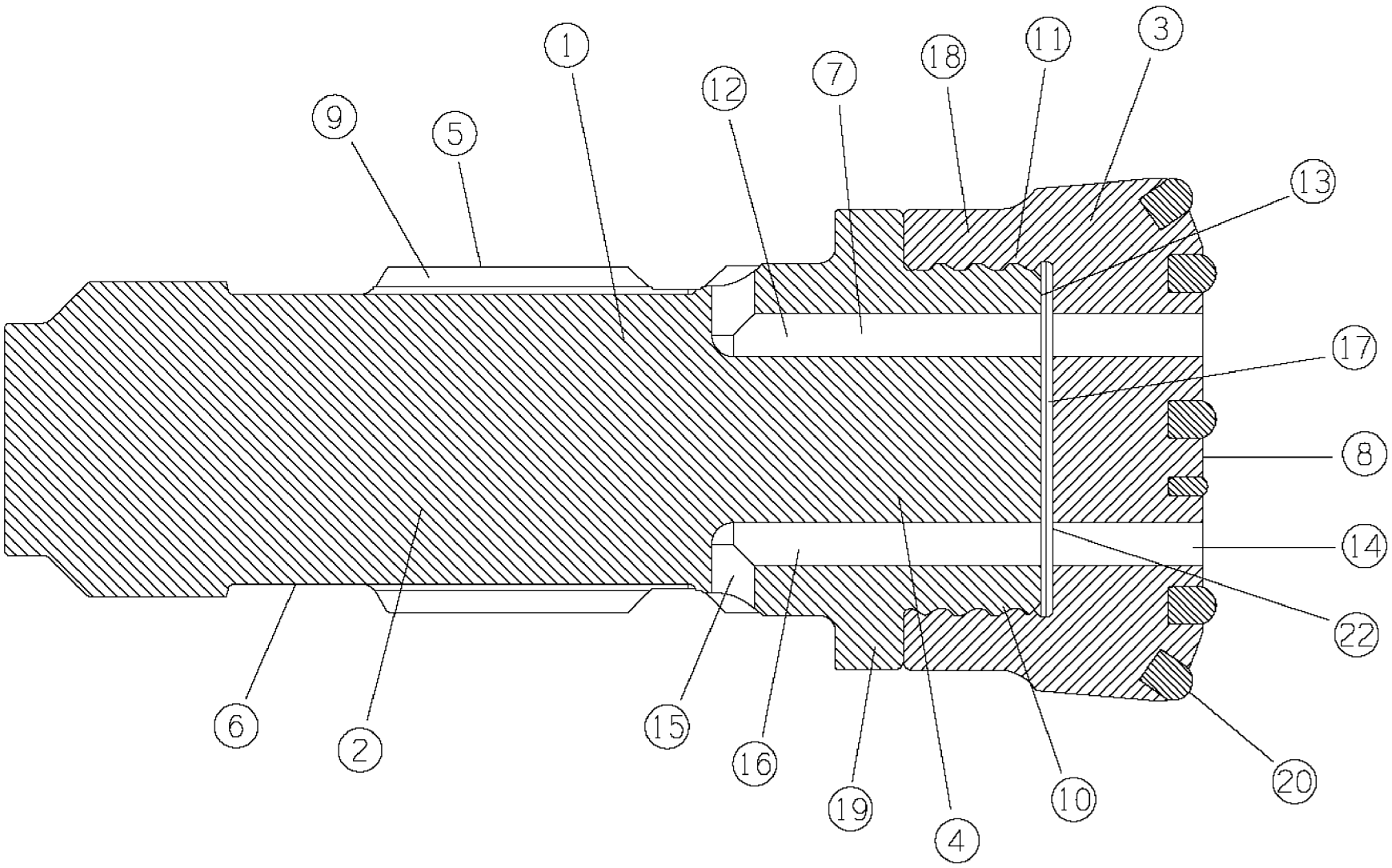
FIG. 2 is a longitudinal cross-section of a drill bit assembly according to a second embodiment of the invention.

A drill bit assembly according to a second embodiment of the invention is illustrated in FIG. 2. The drill bit assembly is substantially similar to that shown in FIG. 1. However, first section 15 of each first channel portion 12 is longer than that of the first embodiment, so that the first channel portions 12 do not intersect the threaded portion of the bit shank. Because the first channel portions do not intersect the threaded portion of the shank, full thread contact is maintained. The shank may also be strengthened due to the flushing holes being more centrally located within the shank.

Figure 3:
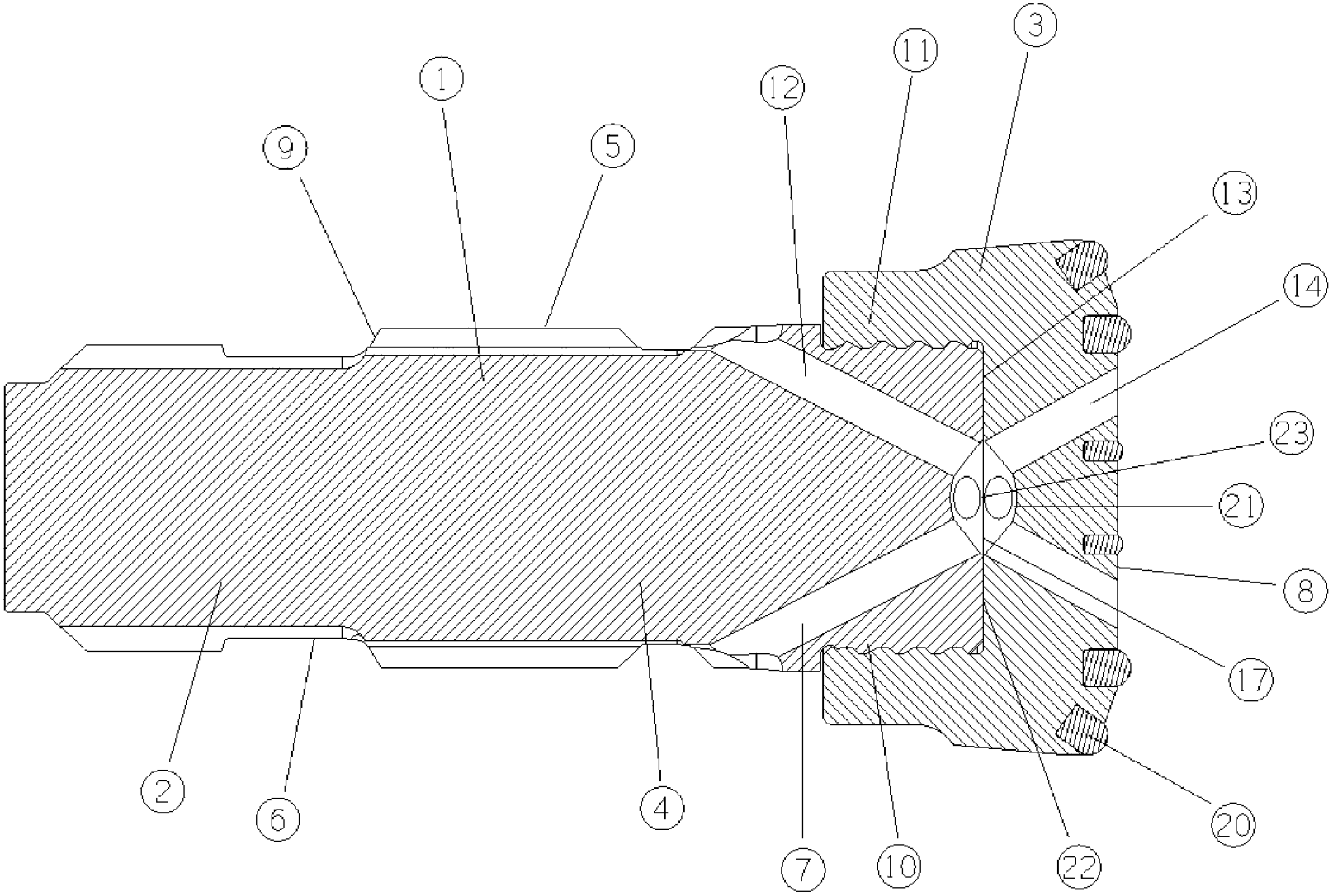
FIG. 3 is a longitudinal cross-section of a drill bit assembly according to a third embodiment of the invention.

A drill bit assembly according to a third embodiment of the invention is illustrated in FIG. 3. As in the first and second embodiments, the assembly 1 comprises a percussion bit 2 having a bit head 3, provided with tungsten carbide inserts 20, screw-threadably connected to an axially extending shank 4. Axially extending splines 5 are formed on an external cylindrical wall 6 of the shank. A male threaded connection 10 is provided at a forward end of the shank to engage with the female threaded connection 11 on the bit head. When the bit is assembled, male connection 10 is engaged with female connection 11 until end face 13 of bit shank 4 abuts the bit head.

Flushing channels 7 extend between the external cylindrical wall 6 of the bit shank and a cutting face 8 of the bit head, to provide a fluid path for a flushing medium between a splined portion 9 of the bit shank and the cutting face 8 of the bit head. Each of the flushing channels 7 comprises a first channel portion 12 in the bit shank extending in an angular direction from the external cylindrical wall of the bit shank to a central portion of the end face 13 of the bit shank adjacent the bit head, and a second channel portion 14 extending in an angular direction through the bit head.

As shown in FIG. 3, a recess 23 is provided in the end face 13 of bit shank 4. A corresponding recess 21 is formed in the internal rear face 22 of the bit head. Recess 23 and recess 21 together form a chamber 17 between the end face 13 of the bit shank and the bit head. The first channel portions 12 and second channel portions 14 are in fluid communication with the chamber 17.

In use, flushing medium travels along the splines 5 into first channel portions 12 and is discharged into chamber 17, from where it passes into second channel portions 14, exiting through the cutting face of the bit to flush cuttings out of the hole while the percussion drill tool operates.

Figure 4:
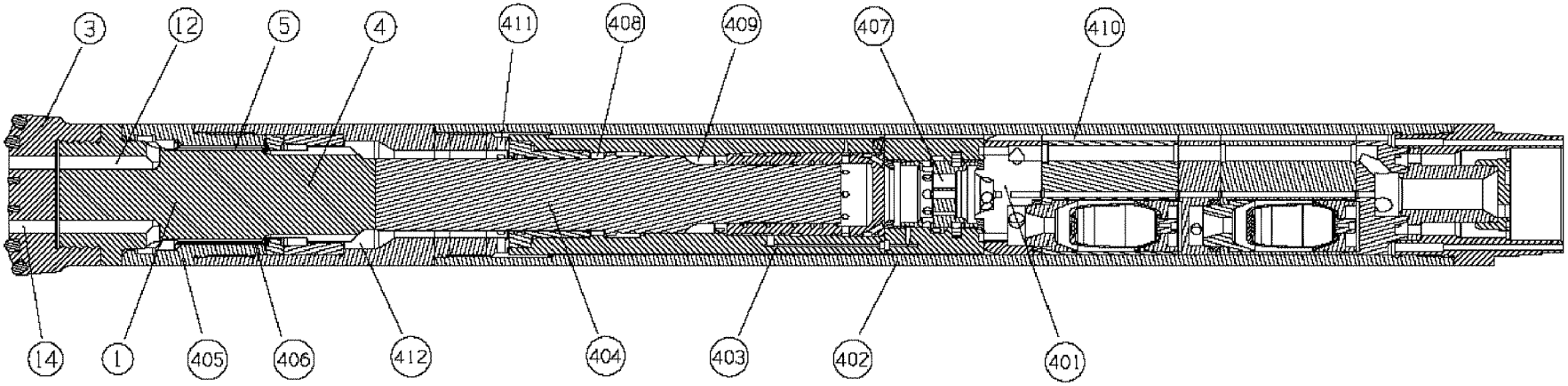
FIG. 4 is a longitudinal cross-section of a hydraulic down-the-hole hammer, incorporating the drill bit assembly of FIG. 2.

A hydraulic down-the-hole hammer according to an embodiment of the invention is illustrated in FIG. 4. The down-the-hole hammer 401 comprises an external cylindrical outer wear sleeve 402. An inner cylinder 403 is mounted co-axially within the outer wear sleeve 402. A sliding piston 404 is mounted for reciprocating movement within the inner cylinder and the outer wear sleeve, to strike a hammer bit assembly 1 located at the forward end of the outer wear sleeve 402 to exercise a percussive force to the drill bit. A shuttle valve 407 controls reciprocation of the piston. A front chamber of the piston 408 is permanently connected to a high pressure line of the device. The shuttle valve connects rear driving chamber 409 of the piston alternately to the high pressure line and a low pressure line of the device to cause the reciprocal movement of the piston.

In the embodiment shown in FIG. 4, the bit assembly is as illustrated in FIG. 2. Rotational forces are transferred from the rotating outer wear sleeve by means of a chuck 405. The hollow cylindrical chuck 405 is machined internally to provide a plurality of axially extending internal splines 406 on its internal wall which engage with the splines 5 of the shank 4 to transmit rotational drive from the chuck 405 to the drill bit.

In use, flushing fluid is supplied through channels 410 and between the outer wear sleeve 402 and the inner cylinder 403, through ports 411 and channels 412 to the splined portion of shank 4, from where it passes through first channel portions 12 in the shank to second channel portions 14 in the bit head, discharging through the cutting face. The fluid may carry lubricating oil which may lubricate the splined connection between the bit shank 4 and the chuck 405.

Figure 5:
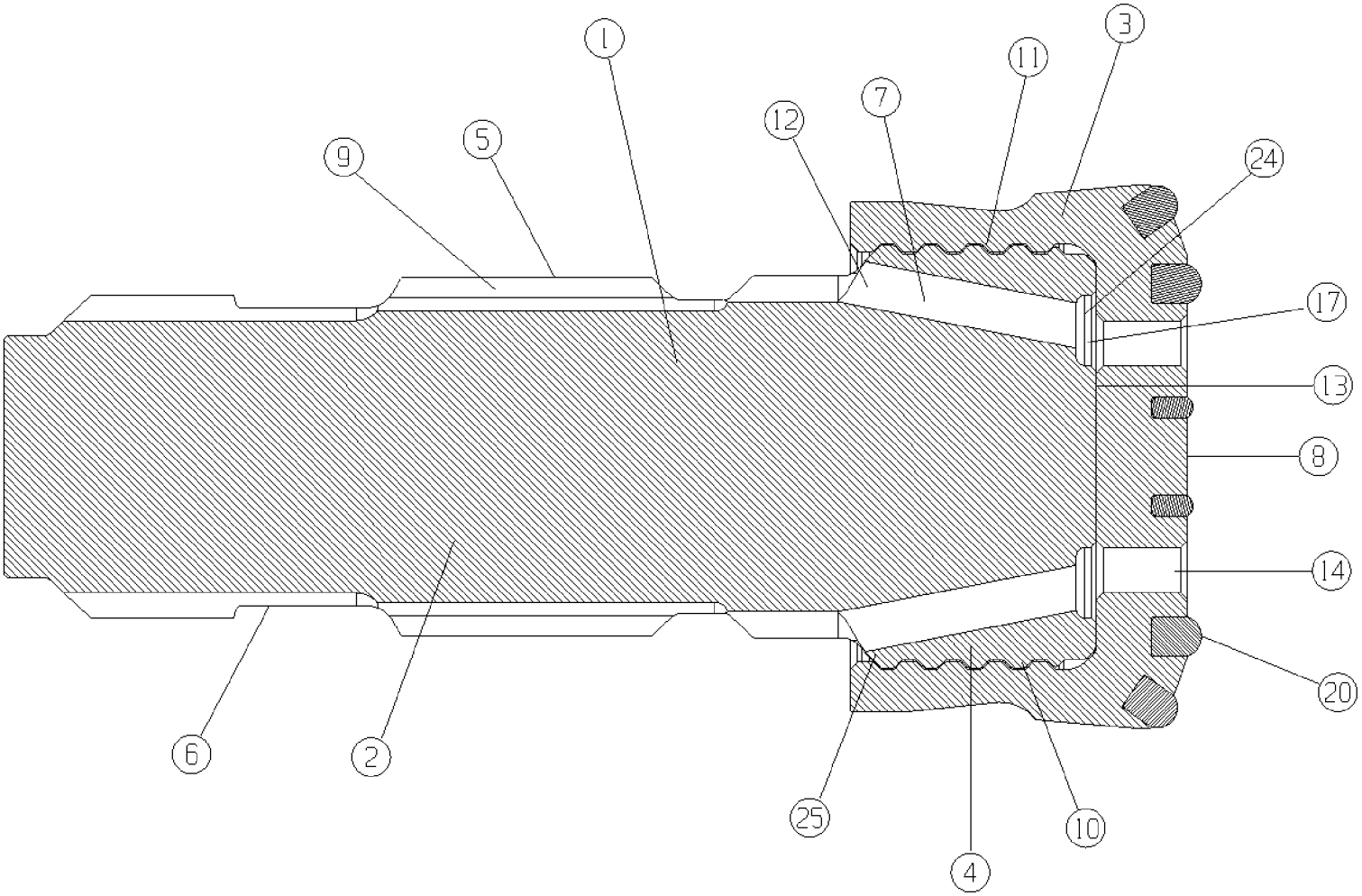
FIG. 5 is a longitudinal cross-section of a drill bit assembly according to a fourth embodiment of the invention.

A drill bit assembly according to a fourth embodiment of the invention is illustrated in FIG. 5. As in the previous embodiments, the assembly 1 comprises a percussion bit 2 having a bit head 3, provided with tungsten carbide inserts 20, screw-threadably connected to an axially extending shank 4. Axially extending splines 5 are formed on an external cylindrical wall 6 of the shank and an outwardly directed shoulder 25 is formed at a forward end of the external cylindrical wall, immediately adjacent the splines. A male threaded connection 10 is provided at the forward end of the shank to engage with the female threaded connection 11 on the bit head. When the bit is assembled, male connection 10 is engaged with female connection 11 until end face 13 of bit shank 4 abuts the bit head.

Flushing channels 7 extend between the external cylindrical wall 6 of the bit shank and a cutting face 8 of the bit head, to provide a fluid path for a flushing medium between a splined portion 9 of the bit shank and the cutting face 8 of the bit head. Each of the flushing channels 7 comprises a first channel portion 12 in the bit shank, and a second channel portion 14 extending through the bit head. The first channel portion 12 extends in an angular direction between the external cylindrical wall 6 of the bit shank and the end face 13 of the bit shank, intersecting the shoulder 25 at a point immediately adjacent the external cylindrical wall at a first end and the end face 13 at a second end.

As shown in FIG. 5, a radial undercut 24 is provided in the end face 13 of bit shank 4. The radial undercut 24 is an annular groove which forms an annular chamber 17 between the end face 13 of the bit shank and the bit head. The second channel portions 14 are chamfered at each end. The first channel portions 12 and second channel portions 14 are in fluid communication with the chamber 17. The annular chamber 17 provides a fluid path between the first and second channel portions 12, 14 regardless of the rotational alignment of the bit head and the bit shank.

In use, flushing medium travels along the splines 5 into first channel portions 12 and is discharged into annular chamber 17, from where it passes into second channel portions 14, exiting through the cutting face of the bit to flush cuttings out of the hole while the percussion drill tool operates.

Figure 6:
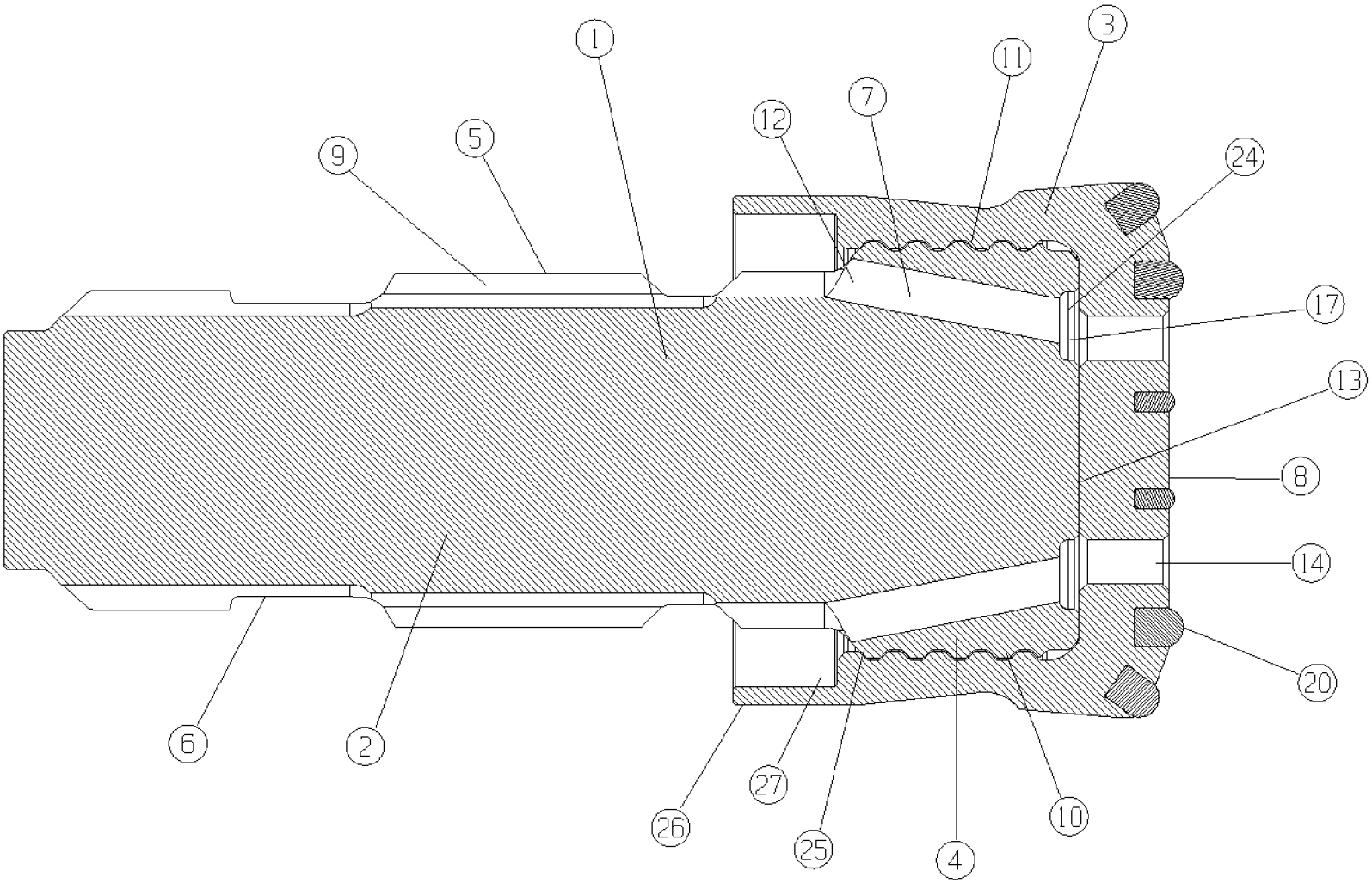
FIG. 6 is a longitudinal cross-section of a drill bit assembly according to a fifth embodiment of the invention.

A drill bit assembly according to a fifth embodiment of the invention is illustrated in FIG. 6. The drill bit assembly is substantially similar to that shown in FIG. 5. However, in this embodiment, the bit head 3 is formed with an axially extending shroud 26, which extends rearwardly beyond the threaded portion 11 of the bit head and the first end of each of the first channel portions. The shroud defines an annular chamber 27 therewithin. When assembled in a hydraulic down-the-hole hammer as shown in FIG. 7, the end of chuck 405 is received in the chamber 27.

In use, flushing medium travels along the splines 5 into the first channel portions 12. From there, it is discharged into annular chamber 17, from where it passes into second channel portions 14, exiting through the cutting face of the bit to flush cuttings out of the hole while the percussion drill tool operates. The shroud 26 minimises leakage of flushing medium from the hammer during operation.

Figure 7:
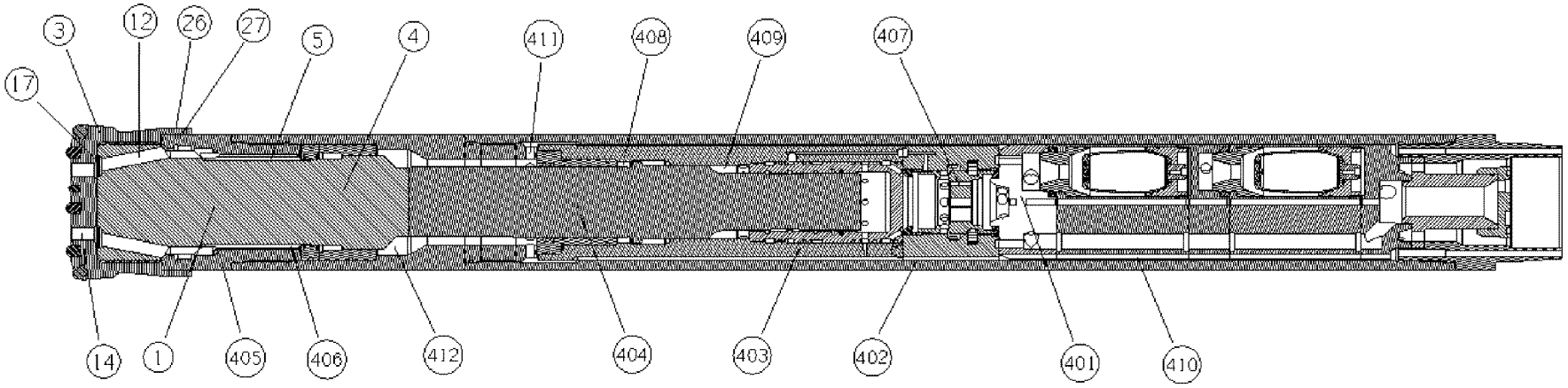
FIG. 7 is a longitudinal cross-section of a hydraulic down-the-hole hammer, incorporating the drill bit assembly of FIG. 6.

A hydraulic down-the-hole hammer according to an embodiment of the invention is illustrated in FIG. 7. The down-the-hole hammer 401 is similar to that shown in FIG. 4 and comprises an external cylindrical outer wear sleeve 402. An inner cylinder 403 is mounted co-axially within the outer wear sleeve 402. A sliding piston 404 is mounted for reciprocating movement within the inner cylinder and the outer wear sleeve, to strike a hammer bit assembly 1 located at the forward end of the outer wear sleeve 402 to exercise a percussive force to the drill bit. A shuttle valve 407 controls reciprocation of the piston. A front chamber of the piston 408 is permanently connected to a high pressure line of the device. The shuttle valve connects rear driving chamber 409 of the piston alternately to the high pressure line and a low pressure line of the device to cause the reciprocal movement of the piston.

In the embodiment shown in FIG. 7, the bit assembly is as illustrated in FIG. 6. Rotational forces are transferred from the rotating outer wear sleeve by means of a chuck 405. The hollow cylindrical chuck 405 is machined internally to provide a plurality of axially extending internal splines 406 on its internal wall which engage with the splines 5 of the shank 4 to transmit rotational drive from the chuck 405 to the drill bit. The axially extending shroud 26 on the bit head 3 extends over the end of the chuck 405.

In use, flushing fluid is supplied through channels 410 and between the outer wear sleeve 402 and the inner cylinder 403, through ports 411 and channels 412 to the splined portion of shank 4, from where it passes through first channel portions 12 in the shank to second channel portions 14 in the bit head, discharging through the cutting face. The fluid may carry lubricating oil which may lubricate the splined connection between the bit shank 4 and the chuck 405.

Figure 8:
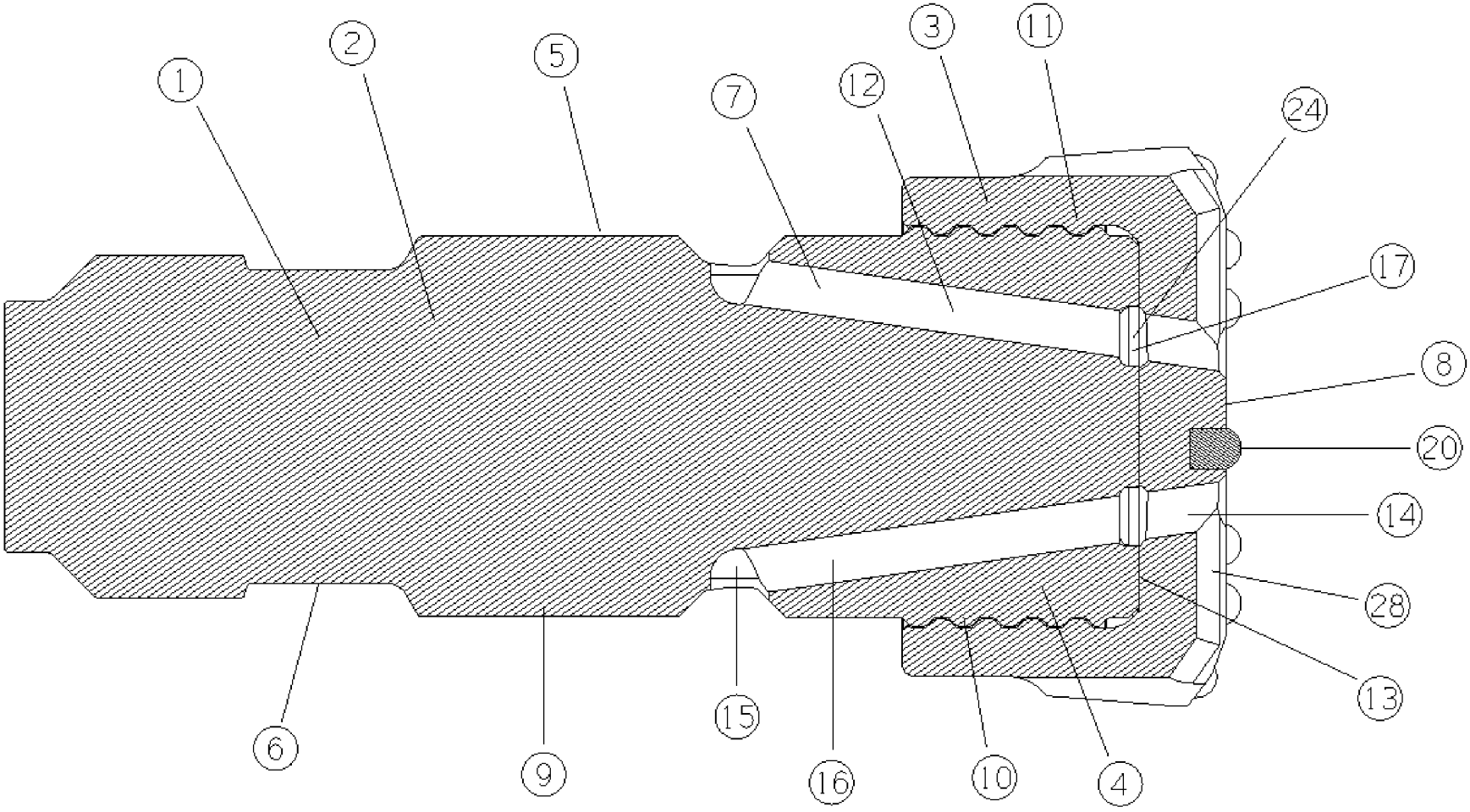
FIG. 8 is a longitudinal cross-section of a drill bit assembly according to a sixth embodiment of the invention.

A drill bit assembly according to a sixth embodiment of the invention is illustrated in FIG. 8. As in the previous embodiments, the assembly 1 comprises a percussion bit 2 having a bit head 3, provided with tungsten carbide inserts 20, screw-threadably connected to an axially extending shank 4. Axially extending splines 5 are formed on an external cylindrical wall 6 of the shank. A male threaded connection 10 is provided at a forward end of the shank to engage with the female threaded connection 11 on the bit head. When the bit is assembled, male connection 10 is engaged with female connection 11 until end face 13 of bit shank 4 abuts the bit head.

Flushing channels 7 extend between the external cylindrical wall 6 of the bit shank and a cutting face 8 of the bit head, to provide a fluid path for a flushing medium between a splined portion 9 of the bit shank and the cutting face 8 of the bit head. Each of the flushing channels 7 comprises a first channel portion 12 in the bit shank extending in an angular direction from the external cylindrical wall of the bit shank to the end face 13 of the bit shank adjacent the bit head, and a second channel portion 14 extending in an angular direction through the bit head. In an alternate embodiment, the second channel portion may be perpendicular to the cutting face 8 of the bit head. Flushing grooves 28 on the cutting face 8 of the bit head allow cuttings to be flushed away from under the cutting face of the bit head.

As shown in FIG. 8, a radial undercut 24 is provided in the end face 13 of bit shank 4. The radial undercut 24 is an annular groove which forms an annular chamber 17 between the end face 13 of the bit shank and the bit head. The second channel portions 14 are chamfered at their inner ends. The first channel portions 12 and second channel portions 14 are in fluid communication with the chamber 17. The annular chamber 17 provides a fluid path between the first and second channel portions 12, 14 regardless of the rotational alignment of the bit head and the bit shank.

In use, flushing medium travels along the splines 5 into first channel portions 12 and is discharged into chamber 17, from where it passes into second channel portions 14, exiting through the cutting face of the bit to flush cuttings out of the hole while the percussion drill tool operates.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A drill bit assembly for fluid-operated percussion drill tools comprising:

a percussion bit comprising a bit head detachably connected to a shank extending along a longitudinal axis;

engagement means formed on an external wall of the shank engageable with complementary engagement means formed internally of a drive chuck whereby rotational drive from the drive chuck may be transmitted to the shank;

at least one flushing channel extending through the shank and the bit head between the external wall of the shank and a cutting face of the bit head, to provide a fluid path for a flushing medium between the external wall of the shank and the cutting face of the bit head, each of the at least one flushing channels comprising:

a first channel portion in the shank extending through the shank from the external wall of the shank at a first end of the first channel portion to an end face of the shank adjacent the bit head at a second end of the first channel portion; and a second channel portion extending through the bit head, wherein the bit head comprises a shroud that extends along the longitudinal axis and beyond the first end of the first channel portion.

2. A drill bit assembly as claimed in claim 1, wherein the first end of the first channel portion intersects an outwardly directed shoulder on the shank adjacent to the external wall.

3. A drill bit assembly for fluid-operated percussion drill tools comprising:

a percussion bit comprising a bit head detachably connected to a shank extending along a longitudinal axis;

engagement means formed on an external wall of the shank engageable with complementary engagement means formed internally of a drive chuck whereby rotational drive from the drive chuck may be transmitted to the shank;

at least one flushing channel extending through the shank and the bit head between the external wall of the shank and a cutting face of the bit head, to provide a fluid path for a flushing medium between the external wall of the shank and the cutting face of the bit head, each of the at least one flushing channels comprising:

a first channel portion in the shank extending through the shank between the external wall of the shank at a first end of the first channel portion and a threaded portion of the shank at a second end of the first channel portion; and a second channel portion extending through the bit head, wherein the first end of the first channel portion intersects the external wall of the shank, and wherein the second end of the first channel portion intersects the threaded portion of the shank.

4. A drill bit assembly for fluid-operated percussion drill tools comprising:

a percussion bit comprising a bit head detachably connected to a shank extending along a longitudinal axis;

engagement means formed on an external wall of the shank engageable with complementary engagement means formed internally of a drive chuck whereby rotational drive from the drive chuck may be transmitted to the shank;

at least one flushing channel extending through the shank and the bit head between the external wall of the shank and a cutting face of the bit head, to provide a fluid path for a flushing medium between the external wall of the shank and the cutting face of the bit head; and a chamber allowing fluid communication between the first channel portion and the second channel portion; the chamber being provided between the end face of the shank and the bit head such that the end face of the shank is spaced apart from an internal rear face of the bit head.

5. A drill bit assembly as claimed in claim 4, wherein each of the at least one flushing channels comprises:

a first channel portion in the shank extending through the shank between the external wall of the shank at a first end of the first channel portion and a threaded portion of the shank at a second end of the first channel portion; and a second channel portion extending through the bit head, and wherein the first end of the first channel portion is adjacent to the external wall of the shank.

6. A drill bit assembly as claimed in claim 4, wherein the chamber is provided by way of a shoulder on the shank engaged with a shoulder on a rear end of the bit head.

7. A drill bit assembly as claimed in claim 4, wherein the chamber is provided by way of a recess in at least one of the end face of the shank and the internal rear face of the bit head, and wherein the first and second channel portions are in fluid communication with the recess.

8. A drill bit assembly as claimed in claim 7, wherein the recess is an annular groove in at least one of the end face of the shank and the internal rear face of the bit head.

9. A drill bit assembly as claimed in claim 7, wherein the recess is centrally located at the end face of the shank, the internal rear face of the bit head, or a combination thereof.

10. A drill bit assembly as claimed in claim 4, wherein the bit head is screw-threadably connected to the shank.

11. A drill bit assembly as claimed in claim 10, wherein the first channel portion extends through the shank between the external wall of the shank and a threaded portion of the shank.

12. A hydraulic down-the-hole hammer comprising a drill bit assembly as claimed in claim 4.

* * * * *